US006585301B1

(12) United States Patent
Prevot et al.

(10) Patent No.: US 6,585,301 B1
(45) Date of Patent: Jul. 1, 2003

(54) LOCK FITTING WITH AT LEAST TWO LOCK BOLTS FOR SLIDING DOORS, WINDOWS OR THE LIKE

(75) Inventors: Gérard Prevot, deceased, late of Willerwald (FR), by Nadine Prevot, heir; Thierry Supernat, Nebing (FR)

(73) Assignee: Ferco International Ferrures et Serrures de Batiment, Reding (FR)

( * ) Notice: Subject to any disclaimer, the term of this patent is extended or adjusted under 35 U.S.C. 154(b) by 0 days.

(21) Appl. No.: 09/290,840

(22) Filed: Apr. 13, 1999

(30) Foreign Application Priority Data

Apr. 17, 1998 (FR) ..... 98 04849

(51) Int. Cl.[7] ..... E05C 19/10
(52) U.S. Cl. ..... 292/8; 292/116
(58) Field of Search ..... 292/8, 30, 135, 292/156, 300, 302, DIG. 46, 24–26, 34–36, 40–42, 37, 116, 119, 132

(56) References Cited

U.S. PATENT DOCUMENTS

| | | | | | |
|---|---|---|---|---|---|
| 2,924,475 | A | * | 2/1960 | Russell | 292/DIG. 46 |
| 3,074,749 | A | * | 1/1963 | Check | 292/DIG. 46 |
| 4,902,056 | A | * | 2/1990 | Prevot | 292/335 |
| 5,290,077 | A | | 3/1994 | Fleming | 292/35 |

FOREIGN PATENT DOCUMENTS

| | | | |
|---|---|---|---|
| EP | 0 629 760 | A | 12/1994 |
| EP | 0 757 146 | | 2/1997 |
| EP | 0 801 194 | A | 10/1997 |
| FR | 2701056 | * | 8/1994 ..... 292/DIG. 46 |

* cited by examiner

*Primary Examiner*—Gary Estremsky
(74) *Attorney, Agent, or Firm*—Kenyon & Kenyon

(57) ABSTRACT

A lock fitting with at least two lock bolts for a sliding door, window, patio door or the like includes a sliding assembly which is mobile inside and in the longitudinal direction of a chamber of the section constituting the front upright of the door, window, patio door or the like. The sliding assembly comprises a first bolt-carrier the opening in which, facing a corresponding first slot in the front wall of the chamber, receives the tail of a first bolt introduced from the outside of the chamber, if necessary in an adjustable manner. The sliding assembly is slidingly connected by an operating rod extending in the longitudinal direction of the section to at least one auxiliary bolt-carrier the opening in which, facing a corresponding second slot in the front wall of the chamber, receives the tail of an auxiliary bolt, if necessary in an adjustable manner. The lock fitting includes at least one auxiliary cartridge which is introduced into the interior of the chamber of the section and fixed directly to the inside face of the front wall of the chamber by its front wall, which includes a slot similar to the corresponding second slot and bears on the inside face around the second slot. The auxiliary cartridge includes an interior cavity which receives the auxiliary bolt-carrier in sliding fashion, the interior cavity having on its inside surface and the auxiliary bolt-carrier having on its outside surface respective complementary conformations extending in the longitudinal direction and formed in the transverse direction of the front wall of the chamber of the section, which cooperate with each other to guide the auxiliary bolt-carrier in the longitudinal direction and to retain the bolt-carrier in the cavity.

79 Claims, 6 Drawing Sheets

LOCK FITTING WITH AT LEAST TWO LOCK BOLTS FOR SLIDING DOORS, WINDOWS OR THE LIKE

BACKGROUND OF THE INVENTION

1. Field of the Invention

The present invention concerns a lock fitting with at least two lock bolts for sliding doors, windows or the like.

The present invention is more particularly concerned with a fitting including a mobile assembly that slides longitudinally in a chamber of the section constituting the front upright of the window, door or the like and which comprises a bolt-carrier the opening in which, facing a corresponding first slot in the front wall of said chamber, is adapted to receive the tail of a bolt inserted from the outside of said chamber, if necessary in an adjustable manner.

2. Description of the Prior Art

Fixing to the lower end of the above assembly a rod adapted to inter-engage with a keeper on the section constituting the bottom cross-member on which the sliding window, door or the like slides is known per se. When the sliding assembly is slid downward to lock the window, door or the like by means of the bolt on the sliding assembly, the free end of the rod inter-engages with the corresponding keeper to complete the locking action.

However, the rod and the bolt can be released from their respective keeper merely by lifting the window, door or the like.

The demand for more secure sliding windows, doors or the like has lead to the need for lock fittings for sliding windows, doors or the like including at least two lock bolts.

This affects not only new installations, which have to be fitted with the required number of bolts at installation time, but also existing installations which are to be modernized by fitting them with auxiliary bolts in the most simple and economic fashion possible.

EP-A-0 757 146 describes a lock fitting of the aforementioned type in which the sliding assembly is slidingly connected by an operating rod extending in the longitudinal direction of the section to at least one auxiliary bolt-carrier the opening in which, facing a corresponding second slot in the front wall of the chamber, is adapted to receive the tail of an auxiliary bolt, if necessary in an adjustable manner.

According to the above document, each auxiliary bolt is mounted on a support block mobile inside the chamber of the section and entrained by a rod that is also mobile inside the chamber of the section.

Each support block is held against the front wall of the chamber by a plate fixed to the wall by screws that pass through slots in the rod.

Each plate has a large slot through which the corresponding support block passes and in which it slides.

The slot formed in each plate to enable the support block to move considerably weakens the resistance of said plate to attempts to force the corresponding bolt.

What is more, all the components of the above lock must be introduced into the chamber at one end of the section, which is labor intensive and makes it difficult to fix the plates against the front wall of the chamber.

The aim of the present invention is to remedy the drawbacks of the prior art systems and to propose a lock fitting of the aforementioned type that is robust, reliable and economic and which can be fitted either when installing new equipment or when modernizing existing equipment of any kind, with minimum inconvenience and at the lowest cost.

SUMMARY OF THE INVENTION

The present invention consists in a lock fitting with at least two lock bolts for a sliding door, window, patio door or the like, the fitting including a sliding assembly which is mobile inside and in the longitudinal direction of a chamber of the section constituting the front upright of the door, window, patio door or the like and which comprises a first bolt-carrier the opening in which, facing a corresponding first slot in the front wall of the chamber, is adapted to receive the tail of a first bolt introduced from the outside of the chamber, if necessary in an adjustable manner, the sliding assembly being slidingly connected by an operating rod extending in the longitudinal direction of the section to at least one auxiliary bolt-carrier the opening in which, facing a corresponding second slot in the front wall of the chamber, is adapted to receive the tail of an auxiliary bolt, if necessary in an adjustable manner, the lock fitting including at least one auxiliary cartridge adapted to be introduced into the interior of the chamber of the section and to be fixed directly to the inside face of the front wall of the chamber by its front wall which includes a slot similar to the corresponding second slot and which includes means for bearing on the inside face around the second slot, and said auxiliary cartridge including an interior cavity adapted to receive the auxiliary bolt-carrier in sliding fashion, the interior cavity having on its inside surface and the auxiliary bolt-carrier having on its outside surface respective complementary conformations extending in the longitudinal direction and formed in the transverse direction of the front wall of the chamber of the section adapted to cooperate with each other to guide the auxiliary bolt-carrier in the longitudinal direction and to retain the bolt-carrier in the cavity.

In this way, the auxiliary cartridge, which is fixed directly to the inside face of the front wall of the chamber, can easily be designed to withstand on its own account and to transmit to the front wall of the section under good conditions forces transmitted to the corresponding auxiliary bolt in the event of an attempt to force said bolt.

Also, the problems of fixing the auxiliary cartridge against the front wall of the chamber can be solved without taking the auxiliary bolt-carrier into account.

In parallel with this, the problems of guiding and retaining the auxiliary bolt-carrier in the cavity of the corresponding auxiliary cartridge can be solved without having to take account of the problems of fixing the auxiliary cartridge against the front wall.

In an advantageous version of the invention, the auxiliary cartridge includes a body having a substantially U-shaped cross section and surrounding the interior cavity, and a cover adapted to be fixed to the body so as substantially to close the interior cavity after introduction of the auxiliary bolt-carrier into the interior of the cavity.

Thus the auxiliary cartridge is prepared in advance and prefabricated, which limits the number of components that installers have to manipulate and fit on site when installing a sliding window, door or the like.

In an interesting version of the invention, the operating rod being adapted to be slidingly fixed outside and near the front wall of the chamber of the section, the front wall of the body adapted to be fixed against the inside face of the front wall of the chamber is opposite the cover and the cover has two internally screwthreaded bushes adapted to receive screws introduced from outside the chamber, through holes in the front wall of the chamber, to fix the body against the front wall of the chamber.

This is a very simple solution to the problem of fixing the auxiliary cartridge to the front wall of the chamber without having to take account of the conditions of entrainment of the auxiliary bolt and the corresponding bolt-carrier by the external rod.

In another beneficial version of the invention, the operating rod is adapted to be introduced into the interior of the chamber and extends parallel to the lateral walls of the chamber.

The auxiliary bolt-carrier is then in the general form of a flat elongate rod carrying projecting on one of its main faces a block of material in which is formed the opening of the auxiliary bolt-carrier, and the opening of the auxiliary bolt-carrier opens in front of a notch in at least one of the side walls of the body of the cartridge forming the front wall of the auxiliary cartridge.

In another aspect the invention consists in an auxiliary cartridge adapted to receive slidingly an auxiliary bolt-carrier itself adapted to receive an auxiliary bolt.

In accordance with the invention, the auxiliary cartridge is adapted to be fitted to a lock fitting constituting the first aspect of the invention.

Other features and advantages of the present invention will become apparent in the following detailed description with reference to the accompanying drawings which are given by way of non-limiting example only.

DETAILED DESCRIPTION OF THE PREFERRED EMBODIMENTS

Figure 1:
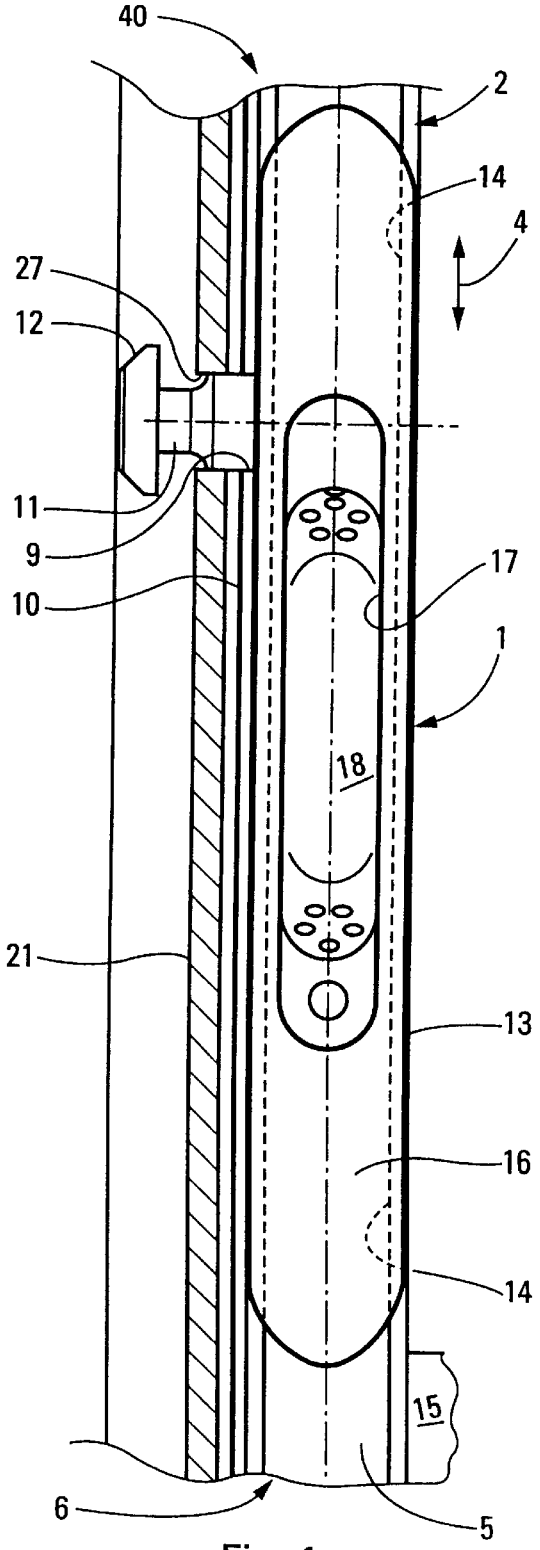
FIG. 1 is a partial view in elevation of the wall forming the inside face of a sliding window, door or the like equipped with an operating assembly constituting a first embodiment of a lock fitting in accordance with the present invention.
Figure 2:
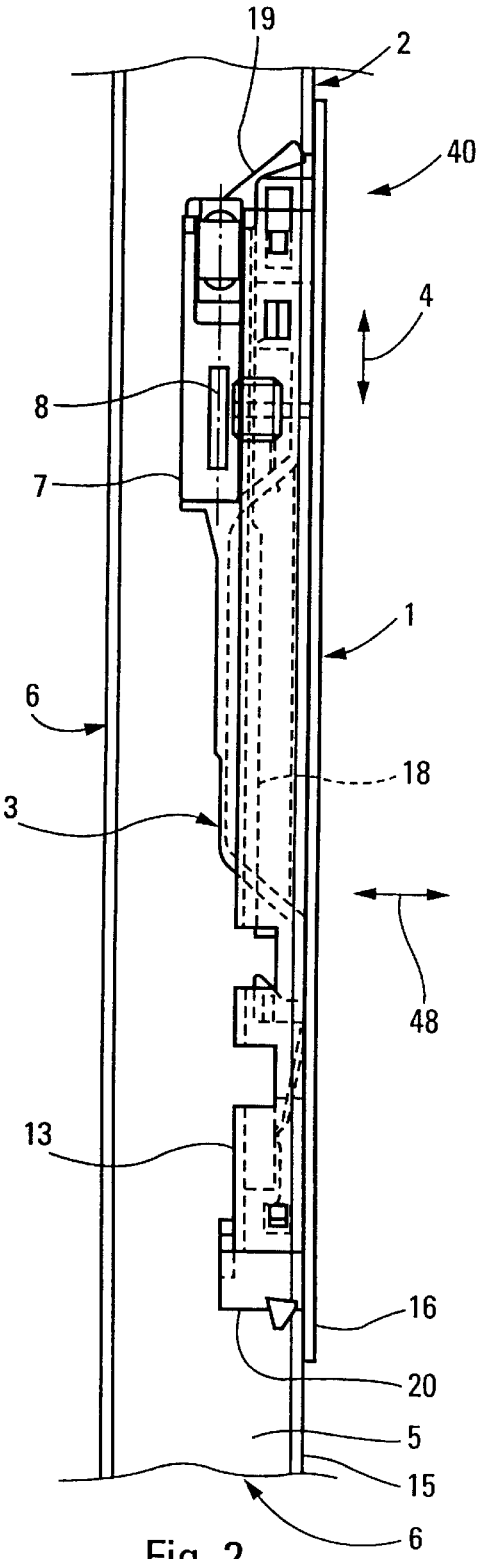
FIG. 2 is a cut-away side view, as seen from the left in FIG. 1, of one embodiment of the operating assembly shown diagrammatically in FIG. 1.

FIGS. 1 and 2 are diagrammatic representations of an operating assembly 1 for a lock fitting 40 of a sliding door, window, patio door or the like 2.

The assembly 1 includes a sliding assembly 3 that is mobile inside and in the longitudinal direction 4 of a chamber 5 of the section 6 constituting the front upright of the window, door or the like 2.

The sliding assembly 3 comprises a bolt-carrier 7 the opening 8 in which, facing a corresponding first slot 9 in the front wall 10 of the chamber 5 constituting the edge of the section 6, is adapted to receive the tail 11 of a bolt 12 inserted from the outside of the chamber 5, if necessary in an adjustable manner.

In the example shown the sliding assembly 3 slides in the direction 4 inside a cartridge 13 that is introduced into the interior of the chamber 5 through a slot 14 formed on the inside wall 15 constituting the inside face of the section 6, i.e. the wall facing toward the interior of the room including the window or the like 2.

The cartridge 13 is attached to a cover plate 16 that covers the slot 14 and which includes a slot 17 providing access to an operating member 18 for moving the sliding assembly 3 one way or the other.

In the example shown, the assembly 1 is fixed to the longitudinal ends of the slot 14 by two fixing members 19 and 20 such that the assembly 1 can be clipped onto the edges of the slot 14 by pushing it into place.

The fixing members 19 and 20 are the fixing members described in French patent application No. 97 04065, for example.

The assembly 1 could also be attached to the edges of the slot 14 by conventional fixing elements that can be introduced with the assembly 1 into the interior of the chamber and then attached to the longitudinal edges of the slot 14 by screws passing through the cover plate 16.

Thus the assembly 1 can be introduced into the interior of the chamber 5 only through the slot 14, which makes it difficult or even impossible to attach the sliding assembly 3 to a rod also inserted into the interior of said chamber 5.

As shown diagrammatically in FIGS. 1, 3, 4, 8 and 9, the sliding assembly 3 is slidingly connected by an operating rod 21 extending in the longitudinal direction 4 of the section 6 to at least one auxiliary bolt-carrier 22 the opening 23 in which, facing a corresponding second slot 24 formed in the front wall 10 of the chamber 5, is adapted to receive the tail 25 of an auxiliary bolt 26, if necessary in an adjustable manner.

As shown diagrammatically in FIG. 1, the rod 21 is fitted outside the chamber 5, in front of and near its front wall 10. The rod 21 therefore has a first hole 27 for the tail 11 of the bolt 12 to pass through and a second hole 28 for the tail 25 of the auxiliary bolt 26 to pass through. In the embodiment shown in detail in FIGS. 7 to 9 the section 6 is such that its inside wall 15 and its outside wall 29 are extended forward in the direction of the arrow 30, beyond the front wall 10 of the chamber 5, by flanges 31, 32 each of which carries a rib 33, 34 extending parallel to the front wall 10 in the longitudinal direction 4 of the section 6. The ribs 33, 34 define guide means adapted to receive the lateral edges 35, 36 of the rod 21 or of any elongate member attached to said rod 21 (see FIG. 9).

Figure 3:
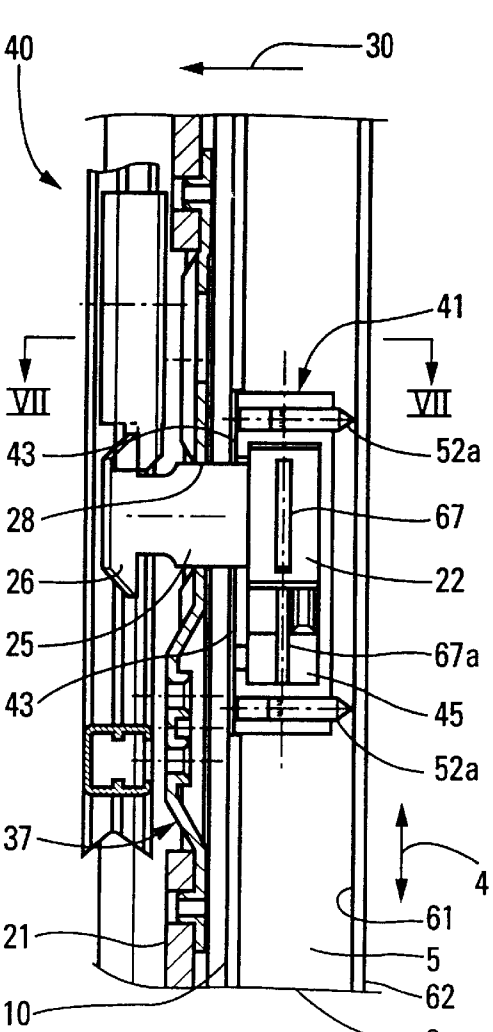
FIG. 3 is a view to a larger scale, similar to FIG. 1, showing one embodiment of an auxiliary cartridge of a lock fitting in accordance with the present invention.

The features of the outside rod 21 and those of the entrainment member 37 shown in FIG. 3 and connected to the rod 21 are described in a French patent application filed the same day as the French patent application from which this application claims priority.

These features are in particular the means of adapting the various types of section 6 to the dimensions of the rebates, in particular to the dimensions of the guide channel 38 formed between the longitudinal ribs 33, 34 and the front wall 10 constituting the back of said rebate (see FIG. 7): the outside rod 21 and/or the entrainment member 37 are generally introduced into the channel 38 and move therein.

The lock fitting 40 in accordance with the invention includes in addition to the assembly 1 at least one auxiliary cartridge 41 adapted to be introduced into the interior of the chamber 5 of the section 6 and to be fixed directly to the inside face 42 of the front wall 10 of the chamber 5 by its front wall 43 which includes a slot 44 facing the corresponding second slot 24 and which includes means for bearing engagement with said inside face 42 around said second slot 24.

The auxiliary cartridge 41 further includes an interior cavity 45 adapted to receive the auxiliary bolt-carrier 22 in sliding fashion. To this end the interior cavity 45 has on its inside surface and the auxiliary bolt-carrier 22 has on its outside surface respective complementary conformations 46, 47 extending in the longitudinal direction 4 and the transverse direction 48 of the front wall 10 of the chamber 5 of the section 6 and adapted to cooperate with each other to guide the auxiliary bolt-carrier 22 in the longitudinal direction 4 and retain the bolt-carrier 22 in the interior cavity 45.

In the embodiment shown in detail in FIGS. 10 to 19 the auxiliary cartridge 41 includes a body 49 having a substantially U-shaped cross section and surrounding the interior cavity 45 and a cover 50 adapted to be fixed to the body 49 so as substantially to close the interior cavity 45 after the auxiliary bolt-carrier 22 has been introduced into the interior of the cavity 45.

As shown in FIGS. 1, 3, 4 and 9 in particular, the operating rod 21 is adapted to be fixed slidingly to the outside of the chamber 5 of the section 6, between the front wall 10 and the longitudinal ribs 33 and 34 of the section 6.

FIGS. 7 to 10, 13 and 16 in particular show that the front wall 43 of the body 49, which is adapted to be fixed against the inside face 42 of the front wall 10 of the chamber 5, is opposite the cover 50.

In this embodiment the cover 50 has two bushes 51 along and projecting from the side of the body 50. The internally screwthreaded bushes 51 are adapted to receive screws 52 introduced from outside the chamber 5 through holes 53 in the front wall 10 of the chamber 5 to fix the body 49 against the front wall 10 of the chamber 5.

Figure 15:
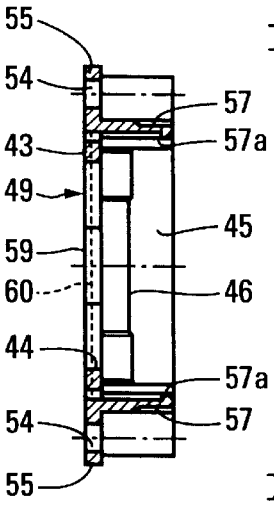
FIG. 15 is a view in section taken along the line XV—XV in FIG. 13.
Figure 13:
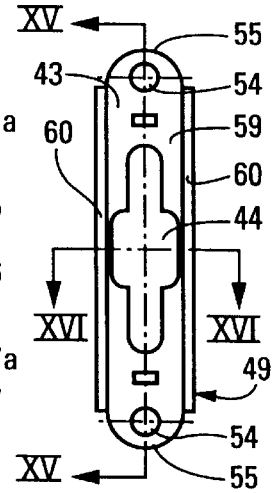
FIG. 13 is a top view of the body of the auxiliary cartridge from FIG. 10.
Figure 14:
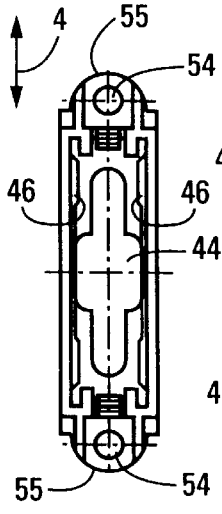
FIG. 14 is a bottom view of the body from FIG. 13.
Figure 16:
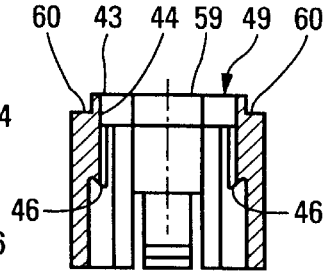
FIG. 16 is a view in section taken along the line XVI—XVI in FIG. 13.
Figure 19:
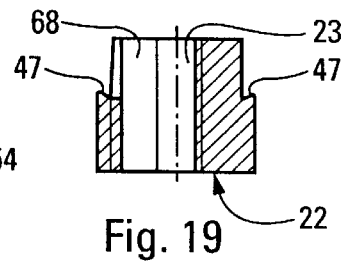
FIG. 19 is a view in section taken along the line XIX—XIX in FIG. 17.

FIGS. 13 to 15 show that the screws 52 pass through holes 54 each formed in a lug 55 extending beyond the corresponding end of the body 49 in the longitudinal direction 4 of the front wall 43 of the body 49.

Accordingly, when the screws 52 are screwed in, the cover 50 presses the body 49 and in particular its front wall 43 against the inside face 42 of the front wall 10.

The body 49 and the cover 50 include respective complementary means 57, 58 for clipping the cover 50 to the body 49 so that the body 49 and the cover 50 are fastened together after the auxiliary bolt-carrier 22 has been introduced into the cavity 45 so that the installer has to handle only a single subassembly constituting the auxiliary cartridge 41.

Figure 12:
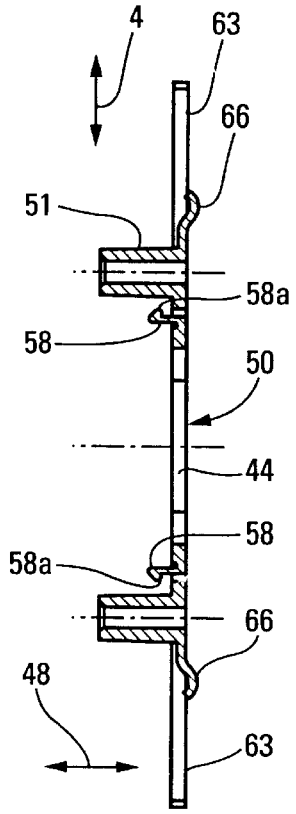
FIG. 12 is a view in section taken along the line XII—XII in FIG. 11.

In the embodiment shown in FIGS. 12 and 15 the cover 50 has two resilient lugs 58 each carrying a projecting stud **58*a* adapted to inter-engage with a corresponding complementary stud 57*a* on a lug 57 of the body 49 of the cartridge 41**.

The front wall 43 of the auxiliary cartridge 41 has an outwardly projecting central region 59 whose outside contour corresponds to the inside contour of the second slot 24 so that it can project through said slot 24 and two shoulders 60 on respective opposite sides of the region 59 extending in the longitudinal direction 4 of the section 6 and adapted to bear against the inside face 42 of the front wall 10 of the section 6.

The auxiliary cartridge 41 can be introduced into the chamber 5 of the section 6 through a slot formed anywhere in the front wall 10 of the section 6 and then moved along the chamber 5 until it is in front of the slot 24.

At least one of the screws 52 for fixing the auxiliary cartridge 41 to the front wall 10 can be a grubscrew **52*a* adapted to bear on the inside face 61 of the rear wall 62 of the chamber 5 of the section 6**.

The grubscrew **52*a* then presses the cover 50 against the body 49 of the auxiliary cartridge 41 and the body 49 against the inside face 42 of the front wall 10 of the section 6, bearing against the rear wall 62 of the chamber 5, an ordinary countersunk screw 52 bearing against the front wall 10 of the section 6** to fulfil the same function.

Figure 5:
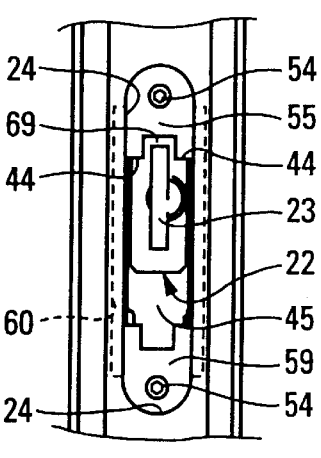
FIG. 5 is a view from the left in FIG. 3, with the bolt and the rod removed to simplify the figure and with the bolt-carrier in a first position.

In the example shown in FIGS. 3 and 5 the auxiliary cartridge 41 is fixed by two grubscrews **52*a* and the central region 59 of the front wall 43 comprises two lugs 55. The grubscrews 52*a* are introduced via the slot 24**.

Figure 6:
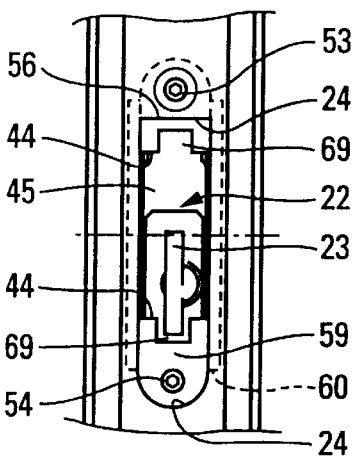
FIG. 6 is a view similar to FIG. 5 and corresponding to FIG. 4, with the bolt-carrier in its other position.
Figure 4:
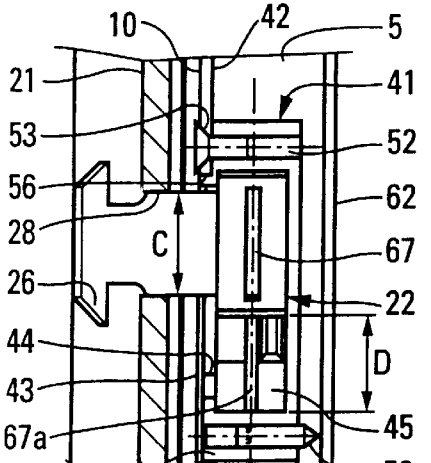
FIG. 4 is a partial view, similar to FIG. 3, of another embodiment of an auxiliary cartridge in accordance with the present invention.

In the example shown in FIGS. 4 and 6 the screw shown in the bottom part of the figure is a grubscrew 52*a* bearing against the rear wall 62 of the chamber 5.

The screw in the upper part of the figure is an ordinary countersunk screw 52 passing through a hole 53 in the front wall 10 and a hole 54 in the corresponding lug 55 which is shaped so that it can be inserted under the front wall 10 as far as the transverse edge 56 of the slot 24.

Figure 11:
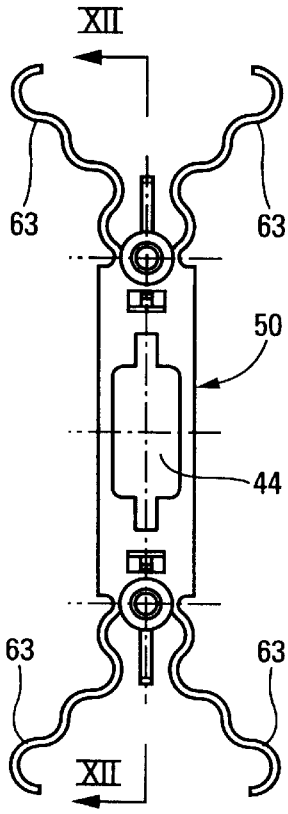
FIG. 11 is a top view of the cover of the auxiliary cartridge from FIG. 10.
Figure 18:
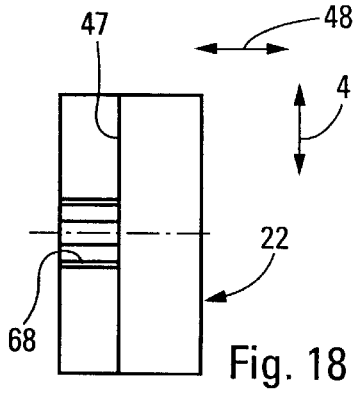
FIG. 18 is an elevation view of the bolt-carrier from FIG. 17 seen from the right in that figure.
Figure 17:
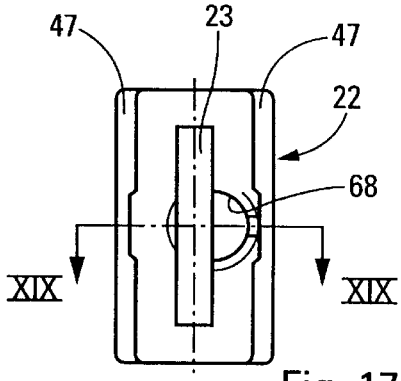
FIG. 17 is a top view of the auxiliary bolt-carrier adapted to slide inside the auxiliary cartridge from FIGS. 10 to 16.

As shown in FIGS. 11 and 12, the auxiliary cartridge 41 has resilient lateral lugs 63, preferably on its cover 50, adapted to bear on the lateral walls 64, 65 of the chamber 5 to center the auxiliary cartridge 41 in the transverse direction 48 of the front wall 10 inside the chamber 5.

The cover 50 of the auxiliary cartridge 41 advantageously has resilient lugs 66 at the rear adapted to bear on the rear wall 62 of the chamber 5.

A complete fitting 40 with a plurality of bolts has therefore been described. The auxiliary cartridges 41 can easily be fitted into the interior of the chamber, either when installing the corresponding sliding window, door or the like with its lock or when converting an existing lock by fitting it with a plurality of auxiliary bolts to increase the resistance of the lock to attempted forcing.

Figure 9:
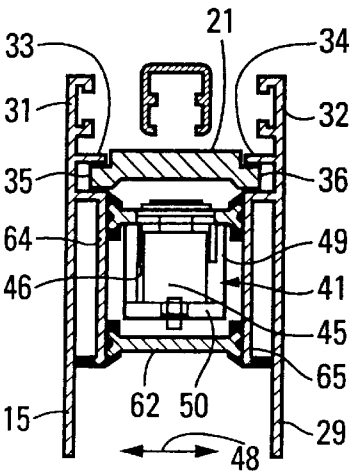
FIG. 9 is a view similar to FIG. 8, also showing the operating rod and the keeper.
Figure 8:
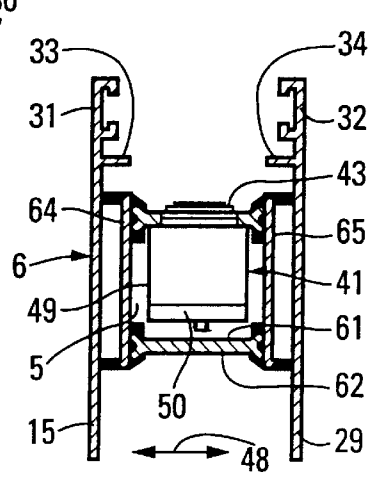
FIG. 8 is a view similar to FIG. 7 showing the auxiliary cartridge in place in the chamber of the section.
Figure 7:
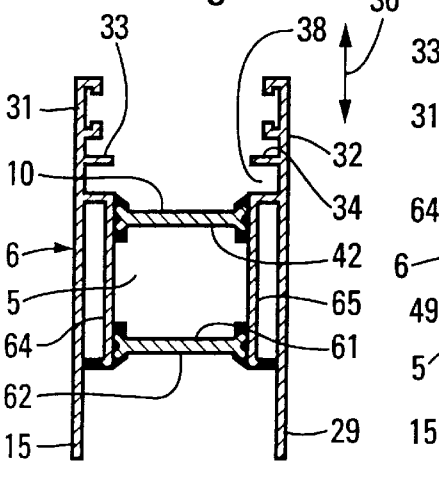
FIG. 7 is a partial view in section taken along the line VII—VII in FIG. 3, showing the section in isolation.
Figure 23:
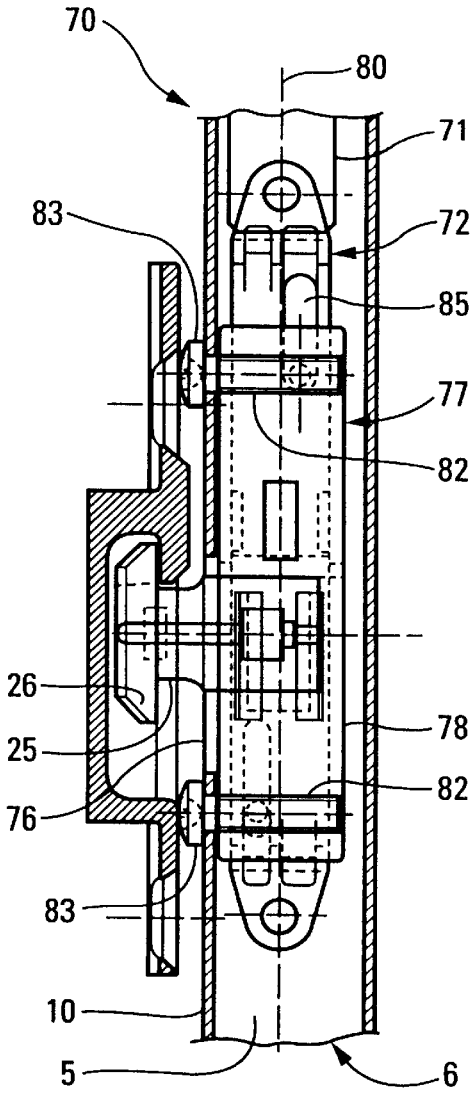
FIG. 23 is a view similar to FIG. 20 showing one embodiment of an auxiliary cartridge in accordance with the present invention adapted to be fitted with the operating assembly from FIG. 20.

The section 6 does not need to have the structure shown in FIGS. 7 to 9. The operating rod 21 entrained by the main bolt 12 could entrain the auxiliary bolts 26 attached to the respective auxiliary bolt-carriers 22. In the event of attempted forcing, the forces transmitted to the auxiliary bolts 26 are absorbed by the corresponding auxiliary cartridge 41 which retransmits them either only to the front wall 10 or simultaneously to the front wall 10 and the rear wall 62 of the section.

In the example shown in FIGS. 16 to 19, the conformations 46 on the inside surface of the cavity 45 comprise two shoulders 46 disposed in the transverse direction 48 and extending in the longitudinal direction 4 of the section 6. The conformations 47 on the outside surface of the bolt-carrier 22 are complementary shoulders 47 disposed in the same transverse direction 48 and extending in the same longitudinal direction 4.

In the embodiment shown diagrammatically in FIGS. 3 and 4, the auxiliary bolt-carrier 22 has a rib 67 projecting in the transverse direction 48 and extending in the longitudinal direction 4. The rib 67 is adapted to penetrate a corresponding groove 67*a* in the inside wall of the cavity 45.

There could of course be a rib 67 on each lateral wall of the auxiliary bolt-carrier 22, the auxiliary cartridge 41 being designed to allow introduction of the auxiliary bolt-carrier 22 into the cavity 45, for example in the longitudinal direction from one end of the cartridge 41. The conformations 46, 47, 67 described hereinabove can be replaced by any other conformation fulfilling the same function.

FIGS. 3 to 6 and 19 show an auxiliary bolt-carrier 22 the opening 23 of which for the tail 25 of the auxiliary bolt 26 to pass through is of generally rectangular shape. The opening 23 has, in the middle of its longer edges, a substantially semi-cylindrical screwthreaded hole 68 receiving a screw for adjusting the position of the tail 25 of the bolt 26 within the opening 23.

In the preferred embodiment shown, which provides the greatest possibility of adapting the installation of the lock fitting on a given window, door or the like to local conditions, the opening 23 is open on both sides of the auxiliary bolt-carrier 22, the slot 44 in the front wall 43 of the auxiliary cartridge 41 is of generally rectangular shape and provides access to the screw for adjusting the bolt in all possible positions of the bolt-carrier 22 relative to the cartridge 41, with two longitudinal extensions 69 through which the tail 25 passes. The length of the slot 44 in the longitudinal direction 4, inclusive of the extensions 69, is at least equal to the sum of the width C of the tail 25 of the bolt 26 and the travel D of the bolt (see FIG. 4).

The slot 24 in the front wall 10 is at least the same size as the slot 44 and here is shaped to allow the central region 59 of the front wall 43 to project into the slot to immobilize the auxiliary cartridge 41 firmly on the front wall 10 by cooperating with the screws 52, 52*a*.

A bolt with no adjustment or with different adjustment means could of course be used, and the respective shapes of the opening 23 and the slots 44 and 24 modified accordingly.

In the example shown in FIGS. 11 and 12, the cover 50 includes a slot 44 through which the free end of an excessively long bolt tail can pass, if necessary.

FIGS. 20 to 29 show an embodiment of a lock fitting 70 in accordance with the invention with a plurality of bolts in which the operating rod 71 is adapted to be introduced into the interior of the chamber 5 and to extend parallel to the lateral walls 64, 65 of the chamber 5.

In this embodiment the auxiliary bolt-carrier 72 is in the general form of a flat elongate rod parallel to the rod 71 and has projecting from one of its main faces a block 73 of material in which the opening 74 of the auxiliary bolt-carrier 72 is formed.

The opening 74 of the auxiliary bolt-carrier 72 opens in front of a notch 75 in at least one of the front or rear walls 76, 78 of the body 79 of said cartridge 77 serving as the front wall 76 of the auxiliary cartridge 77.

In the example shown, the auxiliary cartridge 77 has a plane of symmetry 80, at least with regard to its external configuration, and so each of the two walls 76, 78 features a notch 75 adapted to receive the tail 25 of an auxiliary bolt 26.

Figure 25:
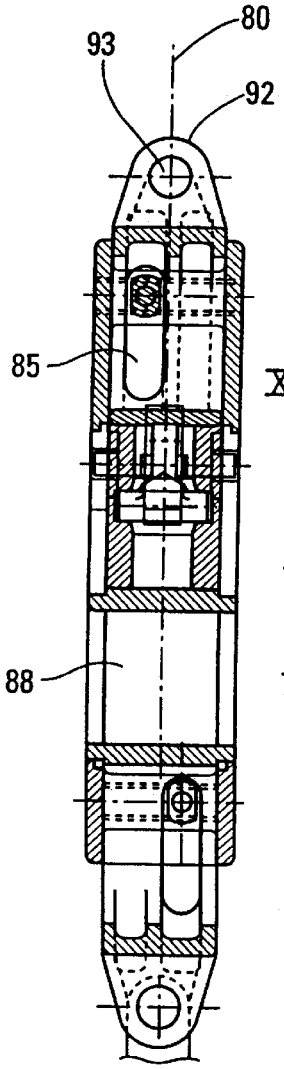
FIG. 25 is a cut-away partial view to a larger scale showing the auxiliary cartridge from FIGS. 23 and 24 as seen from the rear in FIG. 23.
Figure 26:
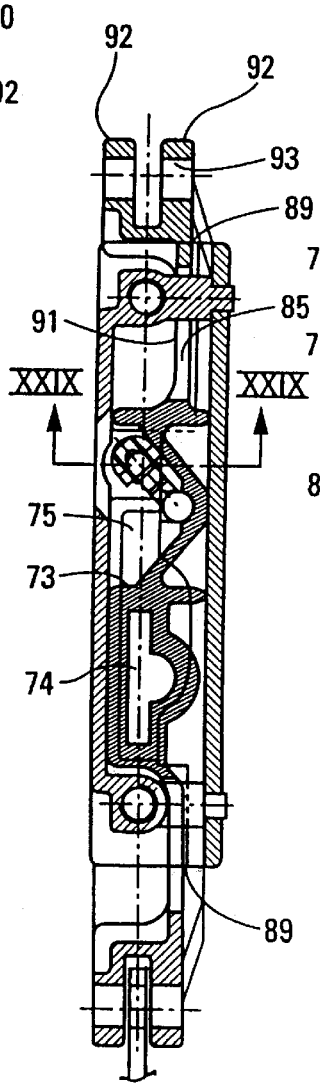
FIG. 26 is a cut-away view of the auxiliary cartridge from FIG. 25 as seen from the left in FIG. 25.
Figure 27:
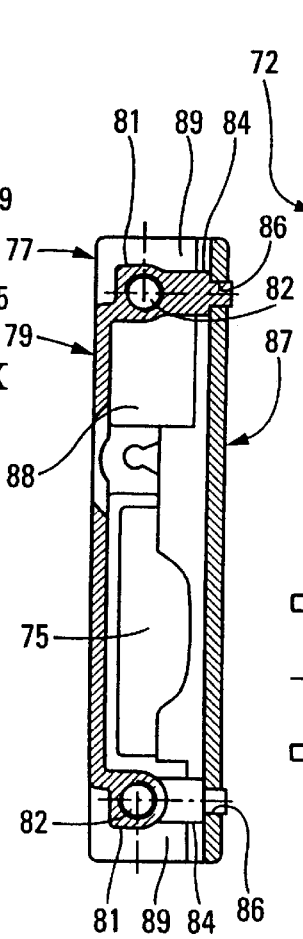
FIG. 27 is a view similar to FIG. 26 showing the auxiliary cartridge in isolation.
Figure 28:
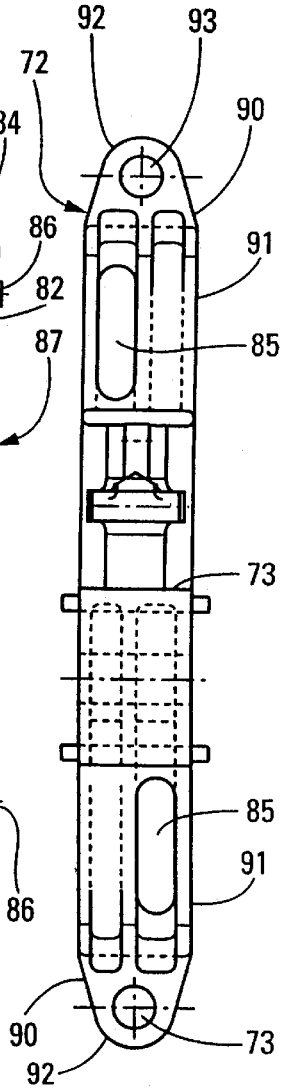
FIG. 28 is a view similar to FIG. 25 showing the bolt-carrier in isolation and from above.

As shown in detail in FIGS. 25 to 27, the body 79 of the auxiliary cartridge 77 includes at least two regions 81 in each of which there is a screwthreaded hole 82 adapted to receive a corresponding screw 83 for fixing the auxiliary cartridge 77 to the front wall 10 of the chamber 5 of the section 6.

Each region 81 carries projecting means 84, for example a riveted member, adapted to pass through a groove 85 of the bolt-carrier 72 and to cooperate with a corresponding hole 86 in the cover 87 to fix the cover 87 to the body 79 of the auxiliary cartridge 77 after the bolt-carrier 72 has been introduced into the interior of the internal cavity 88 of the cartridge 77.

The auxiliary cartridge 77 has at each longitudinal end an opening 89 through which passes one end 90 of the auxiliary bolt-carrier 72 which is shaped so that it can be connected to an operating rod 71. The opening 89 has a flat section and is formed between the corresponding region 81 and the cover 87.

In this example, each end 90 of the auxiliary bolt-carrier 72 has a flat part 91 passing through the opening 89 and featuring the groove 85, extended outward by at least one lug 92 with a hole 93 for fixing one end of a rod 71, for example by means of a screw.

The length of each flat part 91 is at least equal to the travel of the bolt-carrier. The auxiliary bolt-carrier 72 has the projecting block 73 described above between the two flat parts 91, together with a locating pawl analogous to that of the operating assembly (see below).

As shown here, the end 90 preferably has two lugs 92 between which the end of the rod 71 is inserted.

In practice the auxiliary cartridge 77 is necessarily introduced into the interior of the chamber 5 from one end thereof. The bolt-carrier 72 is already fixed to the corresponding rods 71 when the auxiliary cartridge 77 is introduced into the chamber 5.

If the cartridge 77 is connected to another auxiliary cartridge, the latter is fixed to the rod 71 before it is introduced into the interior of the chamber.

Figure 24:
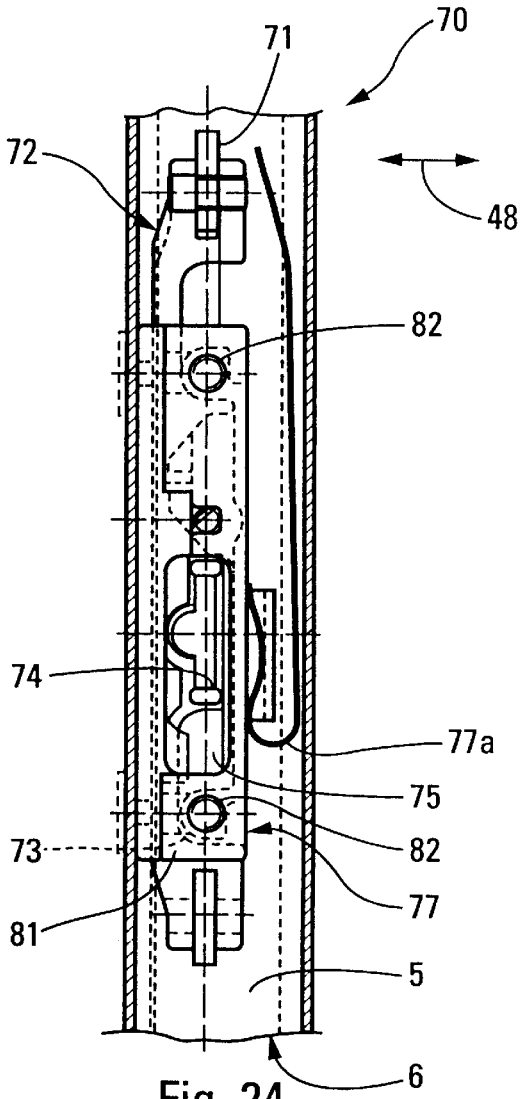
FIG. 24 is a view similar to FIG. 21 of the auxiliary cartridge from FIG. 23.
Figure 10:
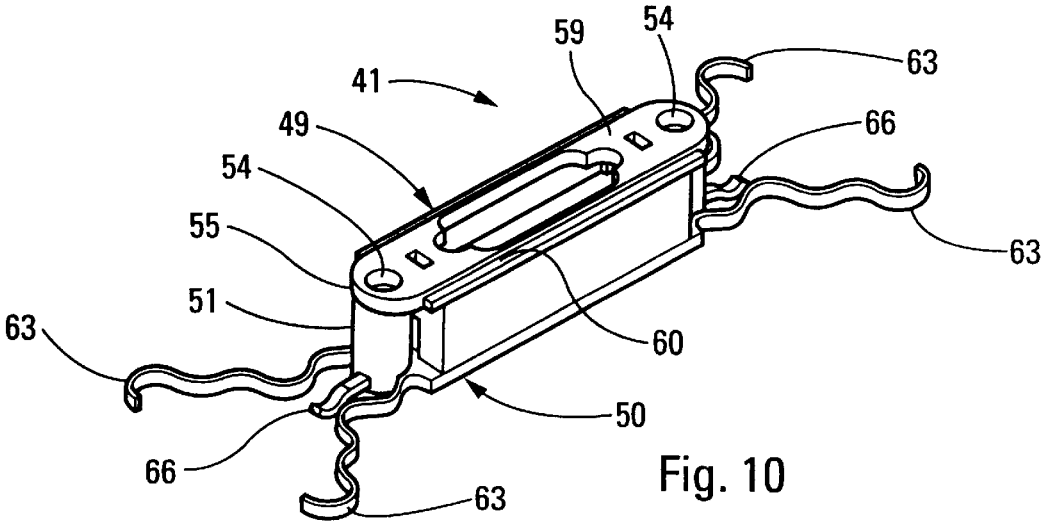
FIG. 10 is a perspective view of one embodiment of the auxiliary cartridge shown in FIGS. 3 to 6, 8 and 9.

In the conventional way, the cartridge 77 in FIG. 24 is equipped with a spring 77*a* for adaptation to a chamber 5 that is very wide in the transverse direction It is a matter of connecting the rod 71 to the corresponding sliding assembly 94.

Figure 20:
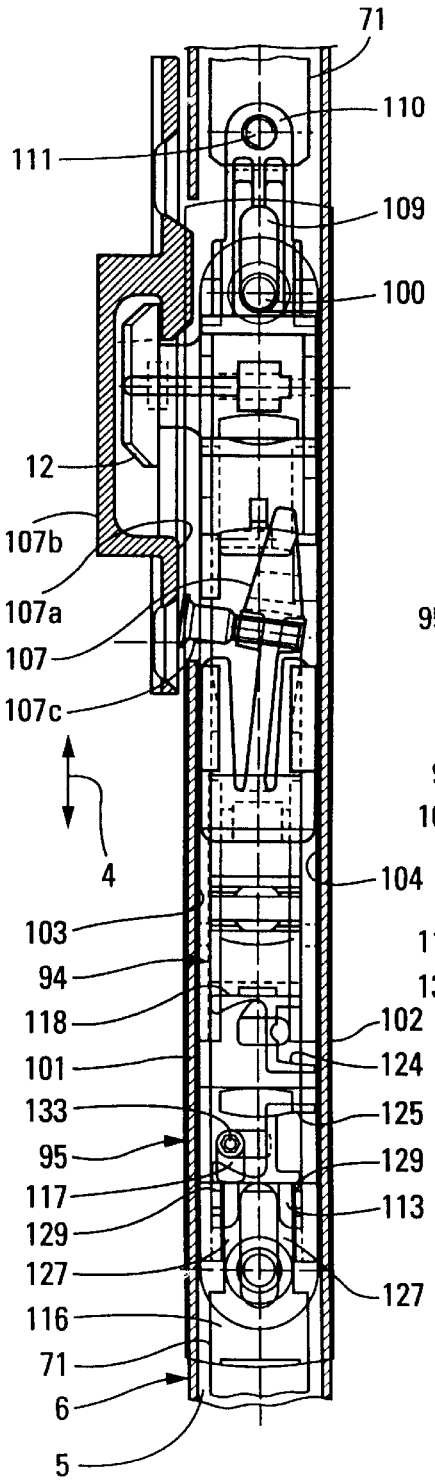
FIG. 20 is a cut-away view similar to FIG. 1 of another embodiment of an actuator assembly of a lock fitting in accordance with the present invention.
Figure 21:
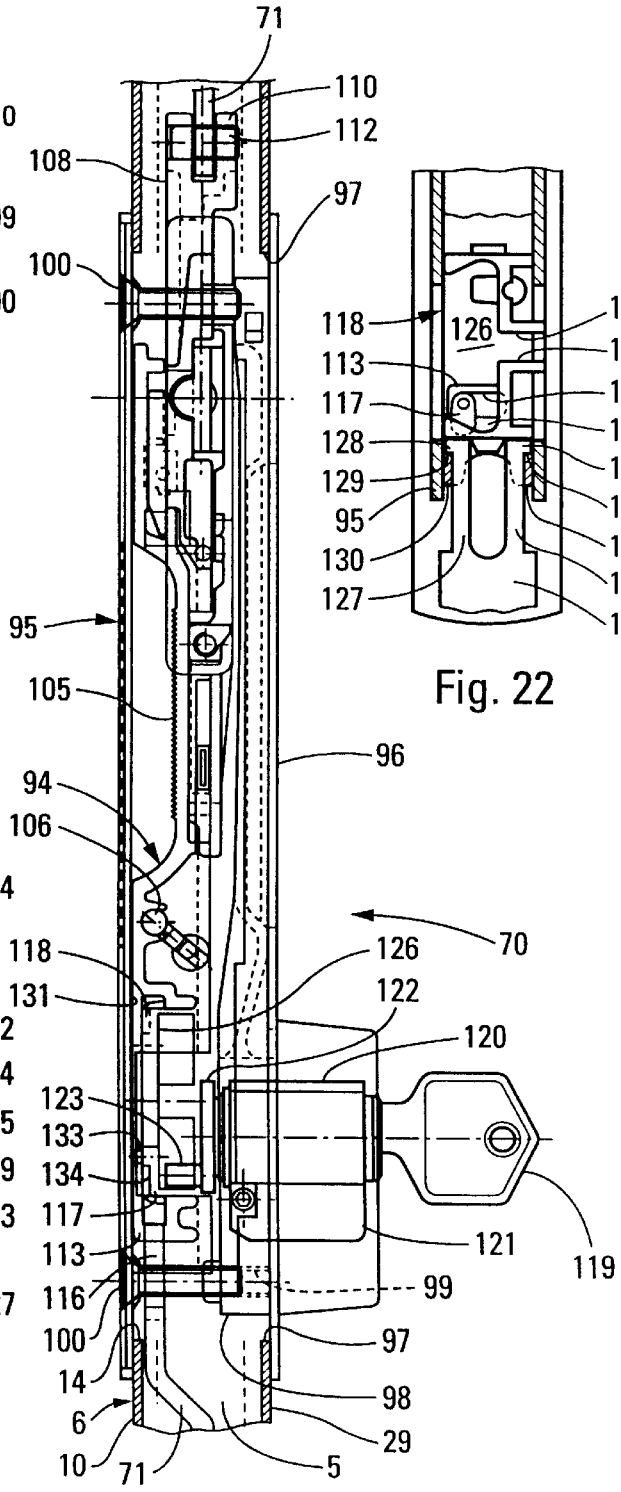
FIG. 21 is a cut-away view in elevation of the assembly from FIG. 20 as seen from the left in that figure.

In the example shown in FIGS. 20 and 21, the lock fitting 70 includes an operating assembly consisting of a main cartridge 95 adapted to be introduced into the interior of the chamber 5 of the section 6 through a corresponding slot 14 in the lateral wall of the chamber 5 and the section 6 constituting the wall and inside face 15 of the sliding window, door or the like 2 and a cover 96 adapted to close an identical slot 97 on the other wall 29 of the chamber 5. The cover 96 has on its inside face two conformations 98 each incorporating a screwthreaded hole 99 adapted to receive a screw 100 for fixing the main cartridge 95 and the cover 96 to the section 6 of the sliding window, door or the like 2.

In a manner that is known per se, the main cartridge 95 is a section which is substantially U-shaped in cross section with lateral walls 101, 102 each of which has its respective outside edge 103, 104 bent substantially at a right angle towards the other lateral wall 102, 101 to guide the sliding assembly 94.

The sliding assembly 94 shown in FIGS. 20 and 21 is known per se. It includes an operating member 105, a pawl 106 adapted to tilt against the action of springs to retain the sliding assembly 94 in a stable manner in each of its extreme positions, and an anti-misoperation member 107 with a feeler finger 107*c* adapted to bear against a wall 107*a* of the keeper 107*b* to move said member 107 and to allow sliding of the sliding assembly 94 from the open position to the locked position (FIG. 20).

To enable the sliding assembly 94 to be connected to at least one auxiliary bolt 72 of an auxiliary cartridge 77, the prior art sliding assembly 94 has been modified and shaped so as to feature, at the longitudinal end 108 shown in the upper part of FIGS. 20 and 21, a slot 109 through which passes the corresponding screw 100 for fixing the main cartridge 94 and a lug 110 through which there is a hole 111 for connecting the lug 110 to a rod 71 by fixing means such as a screw or rivet 112.

The screw 112 can be fitted through the slot 97 when the main cartridge 95 is only partly inserted into the corresponding slot 14.

The sliding assembly 94 has at its other longitudinal end 113 abutment means 114 adapted, when the main cartridge 95 is inserted completely into the corresponding slot 14, to receive complementary abutment means 115 at the end 116 of a second rod 71 to allow the slidin gassembly 94 to entrain the second rod 71 when it slides either way and means for immobilizing the complementary abutment means 115 in their position inter-engaged with the abutment means 114 of the sliding assembly 94.

To enable the second rod 71 to be connected to the second longitudinal end 113 of the sliding assembly 94 via the slot 97, the means for immobilizing the complementary abutment means 115 in their position inter-engaged with the abutment means 114 at the end 113 are mobile relative to the sliding assembly 94 and adapted to be operated from outside the chamber 5 through the slot 97 that can be closed by the cover 95.

In the example shown, the sliding assembly 94 includes a removable plate 118 shaped to enable it to move the sliding assembly 94 from outside the window, door or the like 2 by means of a key 119 operating a cylinder 120 of a lock 121 to the end of which is fixed a disk 122 carrying an eccentric axial finger 123.

In a manner that is per se, the plate 118 has two transverse walls 124, 125 between which the finger 123 can penetrate when the disk 122 turns one way or the other to move the plate 118 in the corresponding longitudinal direction.

The walls 124 and 125 extend over only a portion of the width of the plate 118 to free the back 126 of the plate 118 to allow free movement of the finger 123 on rotation of the disk 122 before and after movement of the plate 118.

Figure 22:
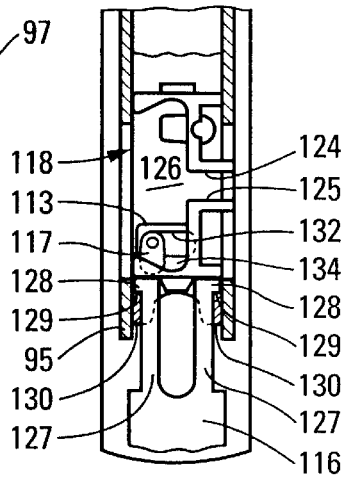
FIG. 22 is a partial view of a detail of FIG. 20.
Figure 29:
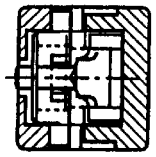
FIG. 29 is a view in section taken along the line XXIX—XXIX in FIG. 26.

As shown in detail in FIG. 22, the end 116 of the rod 71 includes two tongues 127 adapted to extend and slide on respective opposite sides of the corresponding screw 100 for fixing the main cartridge 95. Each tongue 127 has at its free end a member 128 projecting outward and adapted to engage with a complementary notch 129 of a corresponding lateral flange 130 of the sliding assembly 94.

As shown in FIGS. 20 to 22, the removable plate 118 immobilizes each tongue 127 in its engaged position in which the projecting member 128 is engaged in the corresponding notch 129. The removable plate 118 has on its back 126 in contact with the back 131 of the sliding assembly 94 an opening 132 through which passes a pin 117 mounted to pivot on a finger 133 fixed to the back 131 of the sliding assembly. The opening 132 in the back 126 of the plate 117 has a thinner edge 134 to allow the pin 117 to pivot about the finger 133 to immobilize the thinner edge 134 and therefore the plate 118 on the back 131 of the sliding assembly 94. The plate 118 also carries a longitudinal projection 135 which is inserted between the two tongues 127 to immobilize the projecting members 128 in the notches 129 and thereby immobilize the tongues relative to the sliding assembly 94.

The pin 117 is pivoted from outside the chamber 5 by passing a pointed tool through a slot 97.

When the rod 71 is fixed to the sliding assembly 94, the cover 96 can be fitted to cover the slot 97, after verifying that the cylinder 120 is in the open or locked position corresponding to the position of the sliding assembly 94.

The connections between the rod 71 and the sliding assembly 94 just described are mobile connections that facilitate inserting the elements into the interior of the section 6 from the end thereof, in particular by enabling an angular discontinuity at each connection.

Thus the connection by the screw 111 in the upper part of FIGS. 20 and 21 or the connection by the claws 128 of the tongues 127 that accommodate in the notches 129 provides a simple, fast and flexible connection to the sliding assembly 94.

Of course, the present invention is not limited to the embodiments just described and many changes and modifications can be made to them without departing from the field of the invention.

In particular, all components described hereinabove can be replaced by equivalent components of different shape but fulfilling the same function to achieve the same result.

In particular, the auxiliary cartridges and auxiliary bolt-carriers described hereinabove can be used with sliding assemblies and actuator assemblies different from those described.

The main or auxiliary fixed or mobile bolts described hereinabove are known per se and have either one hook or two hooks.

The method of fixing each bolt to the corresponding bolt-carrier is also known per se and does not need to be described here.

What is claimed is:

1. A sliding barrier selected from the group consisting of a door and a window, comprising:

a section constituting a front upright of said sliding barrier; and a lock fitting with at least two lock bolts, said lock fitting including a sliding assembly which is mobile inside and in the longitudinal direction of a chamber of said section and which comprises a first bolt-carrier, the first bolt-carrier including a first opening which faces a corresponding first slot in a front wall of said chamber, the first opening being adapted to receive a tail of a first bolt introduced from outside said chamber through said first slot, the sliding assembly being slidingly connected by an operating rod extending in the longitudinal direction of the chamber to at least one auxiliary bolt-carrier, wherein the at least one auxiliary bolt-carrier including a second opening which faces a corresponding second slot in the front wall of the chamber, the second opening being adapted to receive a tail of an auxiliary bolt, introduced from outside said chamber through said second slot, wherein the lock fitting includes at least one auxiliary cartridge introduced into the interior of said chamber and fixed directly to and against an inside face of the front wall of said chamber by a cartridge front wall which includes a third slot similar to and facing the corresponding second slot and a means for bearing on and against said inside face around said second slot, and wherein said at least one auxiliary cartridge includes an interior cavity in which the at least one auxiliary bolt-carrier is received in sliding fashion, the interior cavity having an inside surface and the at least one auxiliary bolt-carrier having an outside surface, where the inside surface and outside surface have respective complementary conformations extending in the longitudinal direction and formed in a transverse direction of the front wall of the chamber and cooperating with each other to guide the at least one auxiliary bolt-carrier in the longitudinal direction and to retain said at least one auxiliary first bolt-carrier in said cavity.

2. The lock fitting according to claim 1, wherein said at least one auxiliary cartridge includes a body having a substantially U-shaped cross section and surrounding said interior cavity of said at least one auxiliary cartridge and a cover which is fixed to the body and which substantially closes said interior cavity after insertion of said at least one auxiliary bolt-carrier into the interior cavity.

3. The lock fitting according to claim 2, wherein said operating rod is fixed slidingly to the outside of and near the front wall of the chamber of the section, said front wall of said body fixed against the inside face of said front wall of said chamber is opposite said cover and said cover has two internally screw threaded bushes receiving two screws introduced from outside said chamber, through holes in the front wall of said chamber, to fix said body against said front wall of said chamber.

4. The lock fitting according to claim 3, wherein each of the two screws pass through a hole in a lug extending in the longitudinal direction of said front wall of said body beyond the corresponding end of said body.

5. The lock fitting according to claim 2, wherein said body and said cover comprise respective complementary means for clipping said cover to said body.

6. The lock fitting according to claim 2, wherein said front wall of said at least one auxiliary cartridge includes a region projecting outward, having an outside contour corresponding to an inside contour of said second slot, so that the region projects through said second slot, and on respective opposite sides of said region two shoulders extending in the longitudinal direction of said section and bearing against the inside face of said front wall of said section.

7. The lock fitting according to claim 2, wherein said at least one auxiliary cartridge is introduced into said chamber of said section through a slot in said front wall of said section and at least one screw for fixing said at least one auxiliary cartridge to said inside face is a grubscrew bearing on an inside face of a rear wall of said chamber of said section.

8. The lock fitting according to claim 2, wherein said at least one auxiliary cartridge has lateral elastic lugs, bearing on at least one lateral wall of said chamber to center said at least one auxiliary cartridge in a transverse direction inside said chamber and resilient lugs at a rear bearing against a rear wall of said chamber.

9. The lock fitting according to claim 1, wherein said operating rod is inserted into the interior of said chamber and extends parallel to at least one lateral wall of said chamber, and wherein said at least one auxiliary bolt-carrier is in the general form of a flat elongate rod carrying, projecting on at least one main face, a block of material in which is formed the opening of said at least one auxiliary bolt-carrier, and the opening of said at least one auxiliary bolt-carrier opens in front of a notch in at least one of the front and rear walls of the body of said at least one auxiliary cartridge serving as the front wall of said at least one auxiliary cartridge.

10. The lock fitting according to claim 9, wherein said body has at least two regions wherein the at least two regions each has a screw threaded hole receiving a corresponding screw for fixing said at least one auxiliary cartridge to the front wall of said chamber of said section and each region includes projecting means passing through a groove wherein said projecting means includes a riveted member passing through a groove of said at least one auxiliary bolt-carrier and cooperating with a corresponding hole in said cover for fixing said cover to said body of said at least one auxiliary cartridge after inserting said at least one auxiliary bolt-carrier into the internal cavity of said at least one auxiliary cartridge.

11. The lock fitting according to claim 9, wherein said at least one auxiliary cartridge has at each longitudinal end an opening for one end of said at least one auxiliary bolt-carrier to pass through shaped so that it can be connected to an operating rod.

12. The lock fitting according to claim 9, further including a main cartridge inserted into said chamber of said section through a corresponding first lateral wall main slot formed in a first lateral wall of said chamber and the section constituting the inside wall of said sliding barrier and a cover covering an identical second lateral wall main slot on a second lateral wall of said chamber, wherein said cover has two conformations each including a screw threaded hole receiving a screw for fixing said main cartridge and said cover to said section of said sliding barrier, said main cartridge having a substantially U-shaped cross section, where the first lateral wall and second lateral wall each have an outside edge bent substantially at a right angle towards an opposing lateral wall to guide said sliding assembly, wherein said sliding assembly has a first longitudinal end and a second longitudinal end.

13. The lock fitting according to claim 12, wherein said sliding assembly has at said first longitudinal end a slot for a corresponding first screw for fixing said main cartridge to pass through and a lug with a hole through it for connecting said lug to a rod by fixing means, when said main cartridge is only partly inserted into the corresponding first lateral wall main slot to enable the fitting of said fixing means, when said main cartridge is only partly inserted into the corresponding first lateral wall main slot to enable the fitting of said fixing means via the second lateral wall main slot.

14. The lock fitting according to claim 13, wherein the fixing means includes one of a screw and a rivet.

15. The lock fitting according to claim 12, wherein said sliding assembly has said second longitudinal end abutment means receiving, when said main cartridge is introduced completely into the corresponding first lateral wall main slot, complementary abutment means at the end of the second operating rod to enable said sliding assembly to entrain said second operating rod when it slides either way, and a means for immobilizing said complementary abutment means in their position engaged with said abutment means of said sliding assembly.

16. The lock fitting according to claim 15, wherein said means for immobilizing said complementary abutment means of said second operating rod in their engaged position are mobile relative to said sliding assembly and actuated from outside said chamber through said second lateral wall main slot which can be covered by said cover.

17. The lock fitting according to claim 16, wherein said sliding assembly includes a removable plate enabling sliding assembly to be moved from outside said sliding barrier by means of a key operating a cylinder of a lock wherein a first end of the cylinder includes a fixed disk that carries an eccentric finger extending axially, wherein:

a first end of said second rod includes two tongues extending and sliding respective opposite sides of a second screw for fixing said main cartridge, wherein each tongue has an end which includes a member projecting outward engaging with a complementary notch of a corresponding lateral flange of said sliding assembly, and said removable plate immobilizes each tongue in its position engaged in the corresponding notch and has on its back in contact with the back of said sliding assembly an opening through which passes a pin mounted to pivot about a finger fixed to the back of said sliding assembly, the opening in the back of said plate having a thinner edge to allow said pin to pivot about said finger to immobilize said removable plate on the back of said sliding assembly.

18. An auxiliary cartridge in which an auxiliary bolt-carrier is slidingly received, said auxiliary cartridge being adapted to be incorporated in a lock fitting with at least two bolts for a sliding barrier which is selected from the group consisting of a door and a window and which comprises a section constituting a front upright of said sliding barrier, said section comprising a chamber extending in the longitudinal direction of said section and comprising a front wall having an inside face, said auxiliary bolt-carrier being adapted to be mobile inside said longitudinal direction of said chamber and having an opening adapted to receive a tail of a bolt introduced in said opening from outside said chamber through a corresponding slot arranged in said front wall of said chamber, wherein said auxiliary cartridge comprises: a cartridge front wall which includes another slot similar to and adapted to face said corresponding slot and a means adapted to bear on said inside face of the chamber front wall around said corresponding slot, wherein said auxiliary cartridge is adapted to be introduced into an interior of said chamber and to be fixed directly to and against an inside face of the front wall of said chamber by said cartridge front wall and to have a longitudinal direction and a transverse direction thereof coinciding with said longitudinal direction and a transverse direction of said front wall of said chamber; and an interior cavity in which the auxiliary bolt-carrier is received in sliding fashion, the interior cavity having an inside surface and the auxiliary bolt-carrier having an outside surface, wherein the inside surface and outside surface have respective complementary conformations extending in the longitudinal direction and formed in said transverse direction of said auxiliary cartridge on at least one side of said another slot and cooperating with each other to guide the auxiliary bolt-carrier in the longitudinal direction and to retain said auxiliary bolt-carrier in said cavity.

19. A lock fitting adapted to receive at least two lock bolts for a sliding barrier selected from the group consisting of a door and a window, said lock fitting being adapted to be fixed inside and to extend in a longitudinal direction of a chamber of a section constituting a front upright of said sliding barrier, and said lock fitting having a longitudinal direction and a transverse direction which are adapted to coincide with said longitudinal direction and with a transverse direction of a front wall of said chamber, respectively, said lock fitting including:

a sliding assembly which is mobile in said longitudinal direction of said lock fitting and which comprises a first bolt-carrier, the first bolt-carrier including a first opening which is adapted to face a corresponding first slot in said front wall of said chamber, the first opening being adapted to receive the tail of a first bolt introduced from outside said chamber through said first slot, the sliding assembly being slidingly connected by an operating rod that is adapted to extend in the longitudinal direction of the chamber with at least one auxiliary bolt-carrier, the at least one auxiliary bolt-carrier including a second opening which is adapted to face a corresponding second slot in the front wall of the chamber, the second opening being adapted to receive the tail of an auxiliary bolt introduced from outside said chamber through said second slot, the improvement wherein the lock fitting includes at least one auxiliary cartridge having a front wall which includes a third slot similar to and adapted to face the corresponding second slot and a means adapted to bear on said inside face around said second slot, said at least.one auxiliary cartridge being adapted to be introduced into the interior of said chamber and to be fixed directly to and against an inside face of the front wall of said chamber by said cartridge front wall, and wherein said at least one auxiliary cartridge includes an interior cavity in which the at least one auxiliary bolt-carrier is received in sliding fashion, the interior cavity having on its inside surface and the at least one auxiliary bolt-carrier having on its outside surface respective complementary conformations extending in the longitudinal direction and formed in said transverse direction of said lock fitting on at least one side of said third slot and cooperating with each other to guide the at least one auxiliary bolt-carrier in the longitudinal direction and to retain said at least one auxiliary bolt-carrier in said cavity.

20. The lock fitting according to claim 19, wherein said at least one auxiliary cartridge includes a body having a substantially U-shaped cross section and surrounding said interior cavity of said at least one auxiliary cartridge and a cover and which is fixed to the body and which substantially closes said interior cavity after insertion of said at least one auxiliary bolt-carrier into the interior cavity.

21. The lock fitting according to claim 20, wherein said operating rod is adapted to be fixed slidingly to the outside of and near the front wall of the chamber of the section, said front wall of said body adapted to be fixed against the inside face of said front wall of said chamber is opposite said cover, and said cover has two internally screw threaded bushes adapted to receive two screws introduced from outside said chamber, through holes in the front wall of said chamber, to fix said body against said front wall of said chamber.

22. The lock fitting according to claim 21, wherein each of the two screws pass through a hole in a lug extending in the longitudinal direction of said front wall of said body beyond the corresponding end of said body.

23. The lock fitting according to claim 20, wherein said body and said cover comprise respective complementary means for clipping said cover to said body.

24. The lock fitting according to claim 20, wherein said front wall of said at least one auxiliary cartridge includes a region projecting outward, having an outside contour corresponding to an inside contour of said second slot, so that the region is adapted to project through said second slot, and on respective opposite sides of said region two shoulders extending in the longitudinal direction of said section and adapted to bear against the inside face of said front wall of said section.

25. The lock fitting according to claim 20, wherein said at least one auxiliary cartridge is adapted to be introduced into said chamber of said section through a slot in said front wall of said section and at least one screw for fixing said at least one auxiliary cartridge to said inside face is a grubscrew adapted to bear on an inside face of a rear wall of said chamber of said section.

26. The lock fitting according to claim 20, wherein said at least one auxiliary cartridge has lateral elastic lugs, adapted to bear on at least one lateral wall of said chamber to center said at least one auxiliary cartridge in a transverse direction inside said chamber and resilient lugs at a rear adapted to bear against a rear wall of said chamber.

27. The lock fitting according to claim 19, wherein said operating rod is adapted to be inserted into the interior of said chamber and to extend parallel to at least one lateral wall of said chamber, and wherein said at least one auxiliary bolt-carrier is in the general form of a flat elongate rod carrying, projecting on one of its main faces, a block of material in which is formed the opening of said at least one auxiliary bolt-carrier, and the opening of said at least one auxiliary bolt-carrier opens in front of a notch in at least one of the front and rear walls of the body of said at least one auxiliary cartridge serving as the front wall of said at least one auxiliary cartridge.

28. The lock fitting according to claim 27, wherein said body has at least two regions wherein the at least two regions each has a screw threaded hole adapted to receive a corresponding screw for fixing said at least one auxiliary cartridge to the front wall of said chamber of said section and each region includes projecting means, adapted to pass through a groove, wherein projecting means includes a riveted member, adapted to pass through a groove of said at least one auxiliary bolt-carrier and cooperate with a corresponding hole in said cover for fixing said cover to said body of said at least one auxiliary cartridge after inserting said at least one auxiliary bolt-carrier into the internal cavity of said at least one auxiliary cartridge.

29. The lock fitting according to claim 27, wherein said at least one auxiliary cartridge has at each longitudinal end an opening for one end of said at least one auxiliary bolt-carrier to pass through shaped so that it can be connected to an operating rod.

30. The lock fitting according to claim 27, further including a main cartridge adapted to be inserted into said chamber of said section through a corresponding first lateral wall main slot formed in one first of two lateral walls of said chamber and the section constituting the inside wall of said sliding barrier and a cover adapted to cover an identical second lateral wall main slot on the second one of said two lateral walls of said chamber, wherein said cover has two conformations each including a screw threaded hole adapted to receive a screw for fixing said main cartridge and said cover to said section of said sliding barrier, said main cartridge having a substantially U-shaped cross section each one of the two lateral walls of which has its outside edge bent substantially at a right angle towards the other one of the two lateral walls to guide said sliding assembly, wherein said sliding assembly has a first longitudinal end and a second longitudinal end.

31. The lock fitting according to claim 30, wherein said sliding assembly has at said first longitudinal end a slot for a corresponding first screw for fixing said main cartridge to pass through and a lug with a hole through it for connecting said lug to a rod by a fixing means, when said main cartridge is only partly inserted into the corresponding first lateral wall main slot to enable the fitting of said fixing means via the second lateral wall main slot.

32. The lock fitting according to claim 31, wherein the fixing means includes one of a screw and a rivet.

33. The lock fitting according to claim 30, wherein said sliding assembly has at said second longitudinal end abutment means adapted to receive, when said main cartridge is introduced completely into the corresponding first lateral wall main slot, complementary abutment means at the end of a second operating rod to enable said sliding assembly to entrain said second operating rod when it slides either way, and a means for immobilizing said complementary abutment means in their position engaged with said abutment means of said sliding assembly.

34. The lock fitting according to claim 33, wherein said means for immobilizing said complementary abutment means of said second operating rod in their engaged position are mobile relative to said sliding assembly and adapted to be actuated from outside said chamber through said second lateral wall main slot which can be covered by said cover.

35. The lock fitting according to claim 34, wherein said sliding assembly includes a removable plate adapted to enable said sliding assembly to be moved from outside said sliding barrier by means of a key operating a cylinder of a lock wherein a first end of the cylinder includes a fixed disk that carries an eccentric finger extending axially, wherein:

a first end of said second rod includes two tongues adapted to extend and to slide on respective opposite sides of a second screw for fixing said main cartridge, wherein each tongue has an end which includes a member projecting outward adapted to engage with a complementary notch of a corresponding lateral flange of said sliding assembly, and said removable plate is adapted to immobilize each tongue in its position engaged in the corresponding notch and has on its back in contact with the back of said sliding assembly an opening through which passes a pin mounted to pivot about a finger fixed to the back of said sliding assembly, the opening in the back of said plate having a thinner edge to allow said pin to pivot about said finger to immobilize said removable plate on the back of said sliding assembly.

36. A lock fitting which receives at least two lock bolts for a sliding barrier for one of a door and a window, where the lock fitting is fixed inside and extends in a longitudinal direction of a chamber of a section constituting a front upright of the sliding barrier, and the lock fitting having a longitudinal direction and a transverse direction which coincide with the longitudinal direction and a transverse direction of a front wall of the chamber, respectively, the lock fitting includes:

a sliding assembly which is mobile in said longitudinal direction of the lock fitting and which comprises a first bolt-carrier, the first bolt-carrier including a first opening which faces a corresponding first slot in the front wall of the chamber, where the first opening receives a tail of a first bolt introduced from outside the chamber through the first slot, where the sliding assembly being slidingly connected by an operating rod that extends in the longitudinal direction of the chamber with at least one auxiliary bolt-carrier, where the at least one auxiliary bolt-carrier includes a second opening which faces a corresponding second slot in the front wall of the chamber, where the second opening receives the tail of an auxiliary bolt introduced from outside the chamber through the second slot, the improvement wherein the lock fitting includes at least one auxiliary cartridge having a cartridge front wall which includes a third slot which faces the corresponding second slot and a means to bear on an inside face around the second slot, the at least one auxiliary cartridge introduced into an interior of the chamber and to be fixed directly to and against an inside face of the front wall of the chamber by the cartridge front wall, and wherein the at least one auxiliary cartridge includes an interior cavity in which the at least one auxiliary bolt-carrier is received in sliding fashion, the interior cavity having an inside surface and the at least one auxiliary bolt-carrier having an outside surface, wherein the inside surface and outside surface have respective complementary conformations extending in the longitudinal direction and formed in the transverse direction of the lock fitting on at least one side of said third slot and cooperating with each other to guide the at least one auxiliary bolt-carrier in the longitudinal direction and to retain the at least one auxiliary bolt-carrier in the cavity.

37. The lock fitting according to claim 36, wherein said at least one auxiliary cartridge includes a body having a substantially U-shaped cross section and surrounding said interior cavity and a cover which is fixed to the body wherein the cover substantially closes said interior cavity after insertion of said at least one auxiliary bolt-carrier into the interior cavity.

38. The lock fitting according to claim 37, wherein said operating rod is fixed slidingly to the outside of and near the front wall of the chamber of the section, said front wall of said body fixed against the inside face of said front wall of said chamber is opposite said cover and said cover has two internally screw threaded bushes which receive two screws introduced from outside said chamber, through holes in the front wall of said chamber, to fix said body against said front wall of said chamber.

39. The lock fitting according to claim 38, wherein each of the two screws pass through a hole in a lug extending in the longitudinal direction of said front wall of said body beyond the corresponding end of said body.

40. The lock fitting according to claim 37, wherein said body and said cover comprise respective complementary means for clipping said cover to said body.

41. The lock fitting according to claim 37, wherein said front wall of said at least one auxiliary cartridge includes a region projecting outward, having an outside contour corresponding to an inside contour of said second slot, so that the region projects through said second slot, and on respective opposite sides of said region two shoulders extending in the longitudinal direction of said section and bears against the inside face of said front wall of said section.

42. The lock fitting according to claim 37, wherein said at least one auxiliary cartridge which is introduced into said chamber of said section through a slot in said front wall of said section and at least one screw for fixing said at least one auxiliary cartridge to said inside face is a grubscrew which bears on an inside face of a rear wall of said chamber of said section.

43. The lock fitting according to claim 37, wherein said at least one auxiliary cartridge has lateral elastic lugs, which bear on at least one lateral wall of said chamber to center said at least one auxiliary cartridge in a transverse direction inside said chamber and resilient lugs at a rear which bears against a rear wall of said chamber.

44. The lock fitting according to claim 36, wherein said operating rod inserts into the interior of said chamber and to extend parallel to at least one lateral wall of said chamber, and wherein said at least one auxiliary bolt-carrier is in the general form of a flat elongate rod carrying, projecting on one of its main faces, a block of material in which is formed the opening of said at least one auxiliary bolt-carrier, and the opening of said at least one auxiliary bolt-carrier opens in front of a notch in at least one of the front and rear walls of the body of said at least one auxiliary cartridge serving as the front wall of said at least one auxiliary cartridge.

45. The lock fitting according to claim 44, wherein said body has at least two regions wherein the at least two regions each has a screw threaded hole receives a corresponding screw for fixing said at least one auxiliary cartridge to the front wall of said chamber of said section and each region includes projecting means, passes through a groove, wherein projecting means includes a riveted member, passes through a groove of said at least one auxiliary bolt-carrier and cooperate with a corresponding hole in said cover for fixing said cover to said body of said at least one auxiliary cartridge after inserting said at least one auxiliary bolt-carrier into the internal cavity of said at least one auxiliary cartridge.

46. The lock fitting according to claim 44, wherein said at least one auxiliary cartridge has at each longitudinal end an opening for one end of said at least one auxiliary bolt-carrier to pass through shaped so that it can be connected to an operating rod.

47. The lock fitting according to claim 44, further including a main cartridge which inserts into said chamber of said section through a corresponding first lateral wall main slot formed a first lateral wall of said chamber and the section constituting the inside wall of said sliding barrier and a cover which covers an identical second lateral wall main slot a second lateral wall of said chamber, wherein said cover has two conformations each including a screw threaded hole which receives a screw for fixing said main cartridge and said cover to said section of said sliding barrier, said main cartridge having a substantially U-shaped cross section, where the first lateral wall and second lateral wall each have an outside edge bent substantially at a right angle towards an opposing lateral wall to guide said sliding assembly, wherein said sliding assembly has a first longitudinal end and a second longitudinal end.

48. The lock fitting according to claim 47, wherein said sliding assembly has at said first longitudinal end a slot for a corresponding first screw for fixing said main cartridge to pass through and a lug with a hole through it for connecting said lug to a rod by a fixing means, when said main cartridge is only partly inserted into the corresponding first lateral wall main slot to enable the fitting of said fixing means via the second lateral wall main slot.

49. The lock fitting according to claim 48, wherein the fixing means includes one of a screw and a rivet.

50. The lock fitting according to claim 47, wherein said sliding assembly has at said second longitudinal end abutment means which receives, when said main cartridge is introduced completely into the corresponding first lateral wall main slot, complementary abutment means at the end of a second operating rod to enable said sliding assembly to entrain said second operating rod when it slides either way, and a means for immobilizing said complementary abutment means in their position engaged with said abutment means of said sliding assembly.

51. The lock fitting according to claim 50, wherein said means for immobilizing said complementary abutment means of said second operating rod in their engaged position are mobile relative to said sliding assembly and actuate from outside said chamber through said second lateral wall main slot which can be covered by said cover.

52. The lock fitting according to claim 51, wherein said sliding assembly includes a removable plate which enables said sliding assembly to be moved from outside said sliding barrier by means of a key operating a cylinder of a lock wherein a first end of the cylinder includes a fixed disk that carries an eccentric finger extending axially, wherein:

a first end of said second rod includes two tongues which extend and slide on respective opposite sides of a second screw for fixing said main cartridge, wherein each tongue has an end which includes a member projecting outward and engaging with a complementary notch of a corresponding lateral flange of said sliding assembly, and said removable plate immobilizes each tongue in its position engaged in the corresponding notch and has on its back in contact with the back of said sliding assembly an opening through which passes a pin mounted to pivot about a finger fixed to the back of said sliding assembly, the opening in the back of said plate having a thinner edge to allow said pin to pivot about said finger to immobilize said removable plate on the back of said sliding assembly.

53. An auxiliary cartridge in which an auxiliary bolt-carrier is slidingly received, where the auxiliary cartridge is incorporated in a lock fitting with at least two bolts for a sliding barrier, for one of a door and a window, which comprises a section constituting a front upright of the sliding barrier, the section comprising a chamber extending in the longitudinal direction of the section and comprising a front wall having an inside face, where the auxiliary bolt-carrier is mobile inside in the longitudinal direction of said chamber has opening which to receive a tail of a bolt introduced in the opening from outside the chamber through a corresponding slot arranged in the front wall of said chamber, wherein the auxiliary cartridge comprises: a cartridge front wall which includes another slot similar to and adapted to face said corresponding slot and a means to bear on the inside face of the chamber front wall around the corresponding slot, wherein the auxiliary cartridge is introduced into the interior of the chamber and is fixed directly to and against an inside face of the front wall of the chamber by the cartridge front wall and has a longitudinal direction and a transverse direction thereof coinciding with said longitudinal direction and a transverse direction of said front wall of said chamber; and an interior cavity in which the auxiliary bolt-carrier is received in sliding fashion, the interior cavity having an inside surface and the auxiliary bolt-carrier having an outside surface, wherein respective complementary conformations extending in the longitudinal direction and formed in the transverse direction of said auxiliary cartridge on at least one side of the another slot and cooperating with each other to guide the auxiliary bolt-carrier in the longitudinal direction and to retain the bolt-carrier in said cavity.

54. A lock fitting adapted to receive at least two lock bolts for a sliding barrier selected from the group consisting of a door and a window, said lock fitting being adapted to be fixed inside and to extend in a longitudinal direction of a chamber of a section constituting a front upright of said sliding barrier, and a said lock fitting having a longitudinal direction and a transverse direction which are adapted to coincide with said longitudinal direction and with a transverse direction of a front wall of said chamber, respectively, said lock fitting including:

a sliding assembly which is mobile in said longitudinal direction of said lock fitting and which comprises a first bolt-carrier, the first bolt-carrier including a first opening which is adapted to face a corresponding first slot in said front wall of said chamber, the first opening being adapted to receive the tail of a first bolt introduced from outside said chamber through said first slot, the sliding assembly being slidingly connected by an operating rod that is adapted to extend in the longitudinal direction of the chamber with at least one auxiliary bolt-carrier, the at least one auxiliary bolt-carrier including a second opening which is adapted to face a corresponding second slot in the front wall of the chamber, the second opening being adapted to receive the tail of an auxiliary bolt introduced from outside said chamber through said second slot, the improvement wherein the lock fitting includes at least one auxiliary cartridge having a front wall which includes a third slot similar to and adapted to face the corresponding second slot and a means adapted to bear on said inside face around said second slot, said at least one auxiliary cartridge being adapted to be introduced into the interior of said chamber and to be fixed directly to and against an inside face of the front wall of said chamber by said cartridge front wall, and wherein said at least one auxiliary cartridge includes an interior cavity in which the at least one auxiliary bolt-carrier is received in sliding fashion, the interior cavity having on its inside surface and the at least one auxiliary bolt-carrier having on its outside surface respective complementary conformations extending in the longitudinal direction and formed in said transverse direction of said lock fitting on at least one side of said third slot and cooperating with each other to guide the at least one auxiliary bolt-carrier in the longitudinal direction and to retain said at least one auxiliary bolt-carrier in said cavity, wherein said at least one auxiliary cartridge includes a body having a substantially U-shaped cross section and surrounding said interior cavity of said at least one auxiliary cartridge and a cover and which is fixed to the body and which substantially closes said interior cavity after insertion of said at least one auxiliary bolt-carrier into the interior cavity, wherein said operating rod is adapted to be fixed slidingly to the outside of and near the front wall of the chamber of the section, said front wall of said body adapted to be fixed against the inside face of said front wall of said chamber is opposite said cover, and said cover has two internally screw threaded bushes adapted to receive two screws introduced from outside said chamber, through holes in the front wall of said chamber, to fix said body against said front wall of said chamber.

55. The lock fitting according to claim 54, wherein each of the two screws pass through a hole in a lug extending in the longitudinal direction of said front wall of said body beyond the corresponding end of said body.

56. The lock fitting according to claim 54, wherein said at least one auxiliary cartridge is adapted to be introduced into said chamber of said section through a slot in said front wall of said section and at least one screw for fixing said at least one auxiliary cartridge to said inside face is a grubscrew adapted to bear on an inside face of a rear wall of said chamber of said section.

57. The lock fitting according to claim 54, wherein said at least one auxiliary cartridge has lateral elastic lugs, adapted to bear on at least one lateral wall of said chamber to center said at least one auxiliary cartridge in a transverse direction inside said chamber and resilient lugs at a rear adapted to bear against a rear wall of said chamber.

58. The lock fitting according to claim 54, wherein said operating rod is adapted to be inserted into the interior of said chamber and to extend parallel to at least one lateral wall of said chamber, and wherein said at least one auxiliary bolt-carrier is in the general form of a flat elongate rod carrying, projecting on one of its main faces, a block of material in which is formed the opening of said at least one auxiliary bolt-carrier, and the opening of said at least one auxiliary bolt-carrier opens in front of a notch in at least one of the front and rear walls of the body of said at least one auxiliary cartridge serving as the front wall of said at least one auxiliary cartridge.

59. The lock fitting according to claim 58, wherein said body has at least two regions wherein the at least two regions each has a screw threaded hole adapted to receive a corresponding screw for fixing said at least one auxiliary cartridge to the front wall of said chamber of said section and each region includes projecting means, adapted to pass through a groove, wherein projecting means includes a riveted member, adapted to pass through a groove of said at least one auxiliary bolt-carrier and cooperate with a corresponding hole in said cover for fixing said cover to said body of said at least one auxiliary cartridge after inserting said at least one auxiliary bolt-carrier into the internal cavity of said at least one auxiliary cartridge.

60. The lock fitting according to claim 58, wherein said at least one auxiliary cartridge has at each longitudinal end an opening for one end of said at least one auxiliary bolt-carrier to pass through shaped so that it can be connected to an operating rod.

61. The lock fitting according to claim 58, further including a main cartridge adapted to be inserted into said chamber of said section through a corresponding first lateral wall main slot formed in one first of two lateral walls of said chamber and the section constituting the inside wall of said sliding barrier and a cover adapted to cover an identical second lateral wall main slot on the second one of said two lateral walls of said chamber, wherein said cover has two conformations each including a screw threaded hole adapted to receive a screw for fixing said main cartridge and said cover to said section of said sliding barrier, said main cartridge having a substantially U-shaped cross section each one of the two lateral walls of which has its outside edge bent substantially at a right angle towards the other one of the two lateral walls to guide said sliding assembly, wherein said sliding assembly has a first longitudinal end and a second longitudinal end.

62. The lock fitting according to claim 61, wherein said sliding assembly has at said first longitudinal end a slot for a corresponding first screw for fixing said main cartridge to pass through and a lug with a hole through it for connecting said lug to a rod by a fixing means, when said main cartridge is only partly inserted into the corresponding first lateral wall main slot to enable the fitting of said fixing means via the second lateral wall main slot.

63. The lock fitting according to claim 62, wherein the fixing means includes one of a screw and a rivet.

64. The lock fitting according to claim 61, wherein said sliding assembly has at said second longitudinal end abutment means adapted to receive, when said main cartridge is introduced completely into the corresponding first lateral wall main slot, complementary abutment means at the end of a second operating rod to enable said sliding assembly to entrain said second operating rod when it slides either way, and a means for immobilizing said complementary abutment means in their position engaged with said abutment means of said sliding assembly.

65. The lock fitting according to claim 64, wherein said means for immobilizing said complementary abutment means of said second operating rod in their engaged position are mobile relative to said sliding assembly and adapted to be actuated from outside said chamber through said second lateral wall main slot which can be covered by said cover.

66. The lock fitting according to claim 65, wherein said sliding assembly includes a removable plate adapted to enable said sliding assembly to be moved from outside said sliding barrier by means of a key operating a cylinder of a lock wherein a first end of the cylinder includes a fixed disk that carries an eccentric finger extending axially, wherein:

a first end of said second rod includes two tongues adapted to extend and to slide on respective opposite sides of a second screw for fixing said main cartridge, wherein each tongue has an end which includes a member projecting outward adapted to engage with a complementary notch of a corresponding lateral flange of said sliding assembly, and said removable plate is adapted to immobilize each tongue in its position engaged in the corresponding notch and has on its back in contact with the back of said sliding assembly an opening through which passes a pin mounted to pivot about a finger fixed to the back of said sliding assembly, the opening in the back of said plate having a thinner edge to allow said pin to pivot about said finger to immobilize said removable plate on the back of said sliding assembly.

67. A lock fitting which receives at least two lock bolts for a sliding barrier for one of a door and a window, where the lock fitting is fixed inside and extends in a longitudinal direction of a chamber of a section constituting a front upright of the sliding barrier, and the lock fitting having a longitudinal direction and a transverse direction which coincide with the longitudinal direction and a transverse direction of a front wall of the chamber, respectively, the lock fitting includes:

a sliding assembly which is mobile in said longitudinal direction of the lock fitting and which comprises a first bolt-carrier, the first bolt-carrier including a first opening which faces a corresponding first slot in the front wall of the chamber, where the first opening receives a tail of a first bolt introduced from outside the chamber through the first slot, where the sliding assembly is slidingly connected by an operating rod that extends in the longitudinal direction of the chamber with at least one auxiliary bolt-carrier, where the at least one auxiliary bolt-carrier includes a second opening which faces a corresponding second slot in the front wall of the chamber, where the second opening receives the tail of an auxiliary bolt introduced from outside the chamber through the second slot, the improvement wherein the lock fitting includes at least one auxiliary cartridge having a cartridge front wall which includes a third slot which faces the corresponding second slot and a means to bear on an inside face around the second slot, the at least one auxiliary cartridge introduced into an interior of the chamber and to be fixed directly to and against an inside face of the front wall of the chamber by the cartridge front wall, and wherein the at least one auxiliary cartridge includes an interior cavity in which the at least one auxiliary bolt-carrier is received in sliding fashion, the interior cavity having an inside surface and the at least one auxiliary bolt-carrier having an outside surface, wherein the inside surface and outside surface have respective complementary conformations extending in the longitudinal direction and formed in the transverse direction of the lock fitting on at least one side of said third slot and cooperating with each other to guide the at least one auxiliary bolt-carrier in the longitudinal direction and to retain the at least one auxiliary bolt-carrier in the cavity, wherein said at least one auxiliary cartridge includes a body having a substantially U-shaped cross section and surrounding said interior cavity and a cover which is fixed to the body wherein the cover substantially closes said interior cavity after insertion of said at least one auxiliary bolt-carrier into the interior cavity, wherein said operating rod is fixed slidingly to the outside of and near the front wall of the chamber of the section, said front wall of said body is fixed against the inside face of said front wall of said chamber is opposite said cover and said cover has two internally screw threaded bushes receive two screws introduced from outside said chamber, through holes in the front wall of said chamber, to fix said body against said front wall of said chamber.

68. The lock fitting according to claim 67, wherein each of the two screws pass through a hole in a lug extending in the longitudinal direction of said front wall of said body beyond the corresponding end of said body.

69. The lock fitting according to claim 67, wherein said at least one auxiliary cartridge is introduced into said chamber of said section through a slot in said front wall of said section and at least one screw for fixing said at least one auxiliary cartridge to said inside face is a grubscrew bears on an inside face of a rear wall of said chamber of said section.

70. The lock fitting according to claim 67, wherein said at least one auxiliary cartridge has lateral elastic lugs, which bear on at least one lateral wall of said chamber to center said at least one auxiliary cartridge in a transverse direction inside said chamber and resilient lugs at a rear which bears against a rear wall of said chamber.

71. The lock fitting according to claim 67, wherein said operating rod is inserted into the interior of said chamber to extend parallel to at least one lateral wall of said chamber, and wherein said at least one auxiliary bolt-carrier is in the general form of a flat elongate rod carrying, projecting on one of its main faces, a block of material in which is formed the opening of said at least one auxiliary bolt-carrier, and the opening of said at least one auxiliary bolt-carrier opens in front of a notch in at least one of the front and rear walls of the body of said at least one auxiliary cartridge serving as the front wall of said at least one auxiliary cartridge.

72. The lock fitting according to claim 71, wherein said body has at least two regions wherein the at least two regions each has a screw threaded hole receives a corresponding screw for fixing said at least one auxiliary cartridge to the front wall of said chamber of said section and each region includes projecting means, passes through a groove, wherein projecting means includes a riveted member, passes through a groove of said at least one auxiliary bolt-carrier and cooperates with a corresponding hole in said cover for fixing said cover to said body of said at least one auxiliary cartridge after inserting said at least one auxiliary bolt-carrier into the internal cavity of said at least one auxiliary cartridge.

73. The lock fitting according to claim 71, wherein said at least one auxiliary cartridge has at each longitudinal end an opening for one end of said at least one auxiliary bolt-carrier to pass through shaped so that it can be connected to an operating rod.

74. The lock fitting according to claim 71, further including a main cartridge inserted into said chamber of said section through a corresponding first lateral wall main slot formed in a first lateral wall of said chamber and the section constituting the inside wall of said sliding barrier and a cover which covers an identical second lateral wall main slot a second lateral wall of said chamber, wherein said cover has two conformations each including a screw threaded hole receiving a screw for fixing said main cartridge and said cover to said section of said sliding barrier, said main cartridge having a substantially U-shaped cross section, where the first lateral wall and second lateral wall each have an outside edge bent substantially at a right angle towards an opposing lateral wall to guide said sliding assembly, wherein said sliding assembly has a first longitudinal end and a second longitudinal end.

75. The lock fitting according to claim 74, wherein said sliding assembly has at said first longitudinal end a slot for a corresponding with first screw for fixing said main cartridge to pass through and a lug with a hole through it for connecting said lug to a rod by a fixing means, when said main cartridge is only partly inserted into the corresponding first lateral wall main slot to enable the fitting of said fixing means via the second lateral wall main slot.

76. The lock fitting according to claim 75, wherein the fixing means includes one of a screw and a rivet.

77. The lock fitting according to claim 74, wherein said sliding assembly has at said second longitudinal end abutment means which receives, when said main cartridge is introduced completely into the corresponding first lateral wall main slot, complementary abutment means at the end of a second operating rod to enable said sliding assembly to entrain said second operating rod when it slides either way, and a means for immobilizing said complementary abutment means in their position engaged with said abutment means of said sliding assembly.

78. The lock fitting according to claim 77, wherein said means for immobilizing said complementary abutment means of said second operating rod in their engaged position are mobile relative to said sliding assembly and actuate from outside said chamber through said second lateral wall main slot which can be covered by said cover.

79. The lock fitting according to claim 78, wherein said sliding assembly includes a removable plate that enables said sliding assembly to be moved from outside said sliding barrier by means of a key operating a cylinder of a lock wherein a first end of the cylinder includes a fixed disk that carries an eccentric finger extending axially, wherein:

a first end of said second rod includes two tongues that extend and slide on respective opposite sides of a second screw for fixing said main cartridge, wherein each tongue has an end which includes a member projecting outward and engaging with a complementary notch of a corresponding lateral flange of said sliding assembly, and said removable plate immobilizes each tongue in its position engaged in the corresponding notch and has on its back in contact with the back of said sliding assembly an opening through which passes a pin mounted to pivot about a finger fixed to the back of said sliding assembly, the opening in the back of said plate having a thinner edge to allow said pin to pivot about said finger to immobilize said removable plate on the back of said sliding assembly.

* * * * *